US007284550B2

(12) United States Patent
Walker et al.

(10) Patent No.: US 7,284,550 B2
(45) Date of Patent: Oct. 23, 2007

(54) BURN POT FOR FURNACE

(75) Inventors: Robert A. Walker, Ramsey, MN (US); Ross Conrad Embertson, Fridley, MN (US)

(73) Assignee: Bixby Energy Systems, Inc., Rogers, MN (US)

( * ) Notice: Subject to any disclaimer, the term of this patent is extended or adjusted under 35 U.S.C. 154(b) by 16 days.

(21) Appl. No.: 10/802,463

(22) Filed: Mar. 17, 2004

(65) Prior Publication Data

US 2005/0208445 A1 Sep. 22, 2005

(51) Int. Cl.
*F24B 13/02* (2006.01)
*F23J 1/06* (2006.01)
*F23G 5/00* (2006.01)

(52) U.S. Cl. ..... 126/242; 126/148; 126/147; 126/225; 110/167; 110/259

(58) Field of Classification Search ..... 126/144, 126/145, 151, 242, 245, 243, 500, 554, 555, 126/225, 224, 148, 147; 110/317, 165 R, 110/167, 168, 169, 255, 259
See application file for complete search history.

(56) References Cited

U.S. PATENT DOCUMENTS

| | | | | |
|---|---|---|---|---|
| 930,052 | A * | 8/1909 | Devermann | 126/245 |
| 1,804,285 | A * | 5/1931 | Snyder | 110/293 |
| 1,903,634 | A * | 4/1933 | Robinson | 126/182 |
| 1,985,962 | A | 1/1935 | Triggs | |
| 3,126,881 | A * | 3/1964 | Blotsky | 126/25 C |
| 3,209,743 | A * | 10/1965 | Stewart et al. | 126/25 B |
| 5,020,453 | A | 6/1991 | Katsui | |
| 5,261,335 | A | 11/1993 | Blevins, Jr. | |
| 5,297,493 | A * | 3/1994 | Nuesmeyer et al. | 110/233 |
| 5,582,117 | A * | 12/1996 | Mendive et al. | 110/247 |
| 6,830,000 | B2 * | 12/2004 | Mendive et al. | 110/165 R |

FOREIGN PATENT DOCUMENTS

| | | |
|---|---|---|
| CA | 2 358 404 A1 * | 3/2003 |
| JP | 04-158110 | 6/1992 |
| WO | WO-02095296 A1 | 11/2002 |
| WO | WO-05090864 A2 | 9/2005 |

OTHER PUBLICATIONS

"International Search Report and Written Opinion for Application No. PCT/US2005/009060, date mailed Sep. 15, 2005", 13 pages.

* cited by examiner

*Primary Examiner*—Josiah C. Cocks
(74) *Attorney, Agent, or Firm*—Schwegman, Lundberg & Woessner, P.A.

(57) ABSTRACT

A method of combusting a fuel in a burn pot includes forming an ash column within the burn pot, and removing a portion of the ash column. The burn pot includes a first sidewall portion, a second sidewall portion, and a translatable plate interposed between the first sidewall portion and the second sidewall portion. The translatable plate is capable of at least two positions. The translatable plate has an opening therein corresponding substantially to a cross sectional area of an inside area of the first sidewall portion or the second sidewall portion.

18 Claims, 7 Drawing Sheets

BURN POT FOR FURNACE

FIELD OF THE INVENTION

The present invention is related to a structure for a burn pot for a furnace and methods for using the same.

BACKGROUND OF THE INVENTION

Biomass is one of the oldest fuels known to man. Simply stated, biomass is vegetation or fuel from plants, agricultural waste products or the like. During photosynthesis, plants combine carbon dioxide from the air and water from the ground to form carbohydrates that are the building blocks of biomass. The solar energy that drives photosynthesis is stored in the chemical bonds of the structural components of biomass. Burning biomass efficiently extracts the energy stored in the chemical bonds and produces carbon dioxide and water. Generating energy and heat by burning biomass displaces more polluting forms of energy generation and also provides other environmental benefits, such as reducing acid rain, soil erosion, water pollution and pressure on landfills. Additional environmental benefits include mitigating climate changes, providing wildlife habitat, and helping to maintain forest health through better management.

Biomass fuel is both abundant and renewable. There is biomass in virtually every part of the world that can be tapped to create power. If all the biomass potentially available today were used to produce energy an estimated 2,750 Quads. (1 Quad is equal to 1,000,000,000,000,000 BTUs) would be produced. At present, the world population uses only about 7% of the available annual production of biomass. As a result, biomass is not only the logical alternative fuel of the future but is also currently a logical source of energy.

Stoves or furnaces for burning biomass fuel to produce energy are not new. There are many stoves and furnaces for burning biomass fuel, however, there currently is not widespread acceptance of these furnaces or stoves by consumers. Cost is one of the main motivators leading consumers to use a stove or furnace that burns biomass fuels. However, consumers of current biomass fuel stoves or furnaces many times have to compromise in terms of cleanliness and convenience when switching to a furnace that burns biomass fuels. One main area of inconvenience and uncleanliness is the removal of ash from a biomass stove. Currently, this is a messy job that must be performed relatively frequently. Many times, the biomass fuel may not be completely burned. This equates to an inefficient use of the biomass fuel. In addition, when the biomass fuel is not completely burned, the waste or ash produced by the biomass furnace or stove is less dense. The less dense the burned or partially burned fuel, the more frequently the stove or furnace must be cleaned. Less dense ash also means that the ash will be looser and much more apt to fly around as the stove or furnace is cleaned.

SUMMARY OF THE INVENTION

A furnace includes a combustion chamber, and a burn pot within the combustion chamber. The combustion chamber further includes a sidewall, and a movable floor. The movable floor is movable between a first position and a second position. The movable floor has an opening therein having a cross-sectional area at least as large as the cross-sectional area within the sidewall and proximate the movable floor. In some embodiments, the movable floor is movable between a first position where the movable floor has a grill portion therein. When the movable floor is in the first position, the grill portion is positioned near an end of the burn pot. In a second position the movable floor is positioned so the opening therein is near the end of the burn pot.

The burn pot also includes openings in the sidewall for directing air entering the burn pot. In some embodiments, the air is directed so as to form a vortex of air in the burn pot. The furnace also includes an actuator for moving the movable floor. The furnace also includes a plate translatable through an internal volume of the burn pot. The plate has an opening therein with an area at least as large as a cross-sectional area of the burn pot. The plate is translatable between a first position and a second position. The translatable plate has an opening therein with an area at least as large as a cross-sectional area of the burn pot. When the plate is in a first position, the opening substantially aligns with the sidewall of the burn pot. The translatable plate also includes an area capable of covering the cross-sectional area of the burn pot. The translatable plate covers the cross-sectional area of the burn pot when the plate is in the second position. In some embodiments, the plate further includes a ramp positioned near the opening in the plate. The furnace also includes an actuator for moving the translatable plate. In some embodiments, an actuator moves the translatable plate and the movable floor substantially simultaneously.

A burn pot includes a first sidewall portion, a second sidewall portion, and a translatable plate interposed between the first sidewall portion and the second sidewall portion. The translatable plate is capable of at least two positions. The translatable plate has an opening therein corresponding substantially to a cross sectional area of an inside area of the first sidewall portion or the second sidewall portion. The translatable plate also includes a portion capable of separating the first sidewall portion from the second sidewall portion. In some embodiments, the portion capable of separating the first sidewall portion from the second sidewall portion includes a plurality of grill openings therein. The translatable plate includes an actuator for translating the translatable plate. The burn pot further includes a movable floor. The movable floor also includes a grill in a first area and has an opening therein in a second area. The burn pot, in some embodiments, also includes an actuator for moving the movable floor between at least a first position and a second position. The grill is positioned near an end of the second portion of the burn pot when in a first position, and the opening is positioned near an end of the second portion of the burn pot when the movable floor is in a second position. In some embodiments, an actuator moves both the movable floor and the translatable plate. In some embodiments, the actuator moves the movable floor and the translatable plate substantially simultaneously. The burn pot further includes an igniter in fluid communication with the burn pot.

A method includes combusting a fuel in a burn pot, forming an ash column within the burn pot, and removing a portion of the ash column. Removing a portion of the ash column includes cutting a portion of the ash column. In some embodiments, the portion of the ash column that is removed is more completely burned than another portion of the ash column. The method also includes adding fuel to the top of the ash column. In some embodiments, removing a portion of the ash column includes removing a bottom portion of the ash column includes removing a portion of the ash column opposite from the end of the ash column that receives fuel. In some embodiments, removing a portion of the ash column includes removing the portion of the ash column during combustion of at least a portion of the ash column.

BRIEF DESCRIPTION OF THE DRAWINGS

The invention is pointed out with particularity in the appended claims. However, a more complete understanding of the present invention may be derived by referring to the detailed description when considered in connection with the figures, wherein like reference numbers refer to similar items throughout the figures, and:

The description set out herein illustrates the various embodiments of the invention, and such description is not intended to be construed as limiting in any manner.

DETAILED DESCRIPTION

In the following detailed description of the preferred embodiments, reference is made to the accompanying drawings that form a part hereof, and in which are shown by way of illustration specific embodiments in which the invention can be practiced. The embodiments illustrated are described in sufficient detail to enable those skilled in the art to practice the teachings disclosed herein. Other embodiments can be utilized and derived therefrom, such that structural and logical substitutions and changes can be made without departing from the scope of present inventions. The following detailed description, therefore, is not to be taken in a limiting sense, and the scope of various embodiments of the invention is defined only by the appended claims, along with the full range of equivalents to which such claims are entitled.

Figure 1:
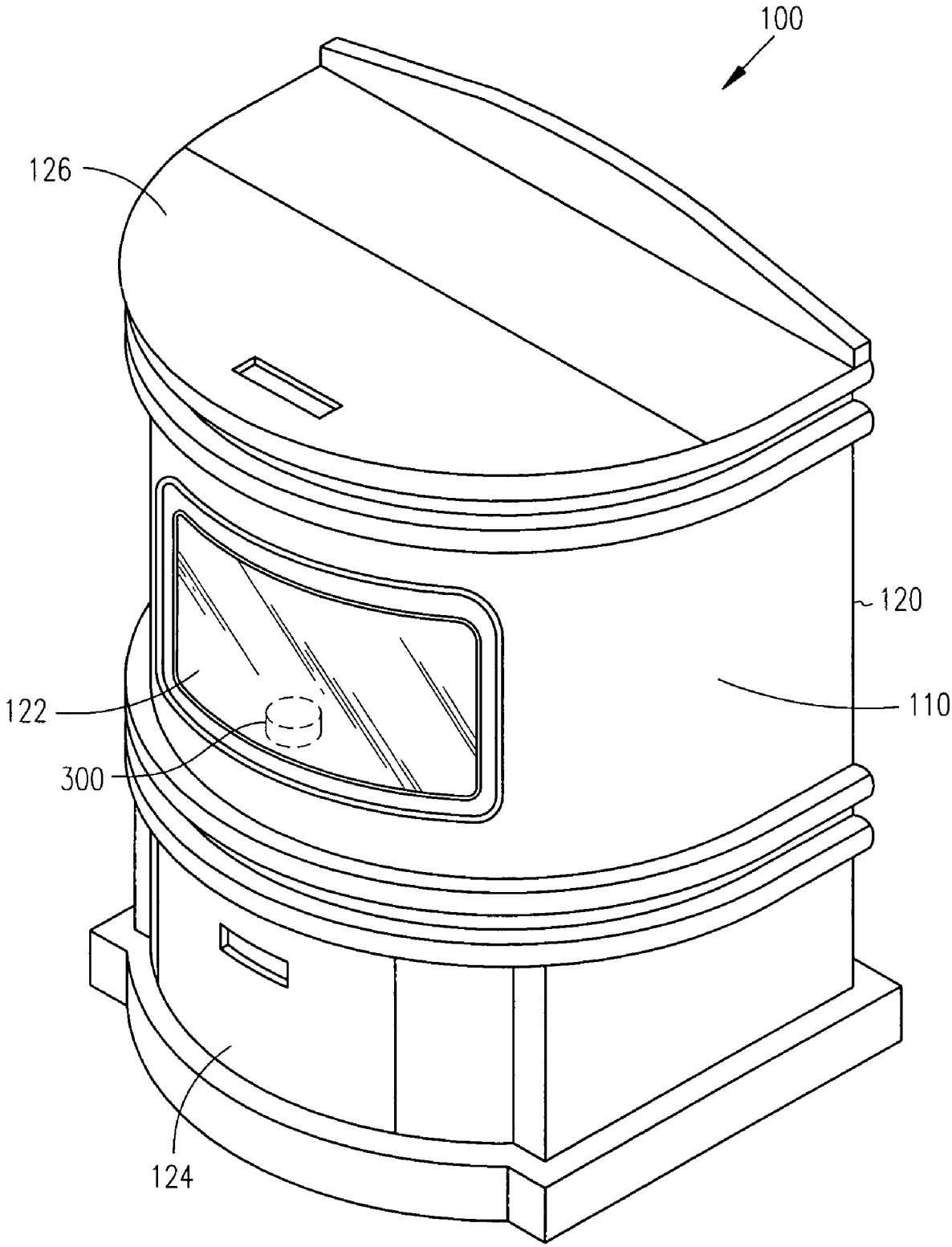
FIG. 1 is perspective view a furnace having a combustion chamber with the burn port, according to an embodiment of this invention.

FIG. 1 is perspective view a furnace 100 having a combustion chamber 110 with the burn port 300, according to an embodiment of this invention. The furnace 100 includes a housing 120. The combustion chamber 110 and burn pot 300 are within the housing 120. At least a portion of the burn pot 300 and at least a portion of the combustion chamber 110 a viewable through a window 122. The window 122 is sealed with respect to the housing 120. The housing 120 also includes an access panel 124 that allows access to a portion of the interior of the furnace 100 located below the burn pot 300. The access panel, in some embodiments, allows users to remove combustion products from the furnace 100. The housing 120 also includes a hopper and a feed mechanism (not shown) for controllably placing biomass combustibles into the burn pot 300 in the combustion chamber 110. The housing 120 of the furnace includes a door 126 that allows access to the hopper (not shown). Biomass fuels are placed into the hopper after opening door 126. Any type of biomass can be used as a fuel. For example, corn, wood chips, or pellets of biomass material are among the fuel sources. The furnace 100 is shown in FIG. 1 in a space heater application. Other applications of the furnace include a forced air furnace, a hot water heater, an electrical generator, a swimming pool heater, or for heating water for circulation within a hot water heating system. Other applications are also contemplated.

Figure 2:
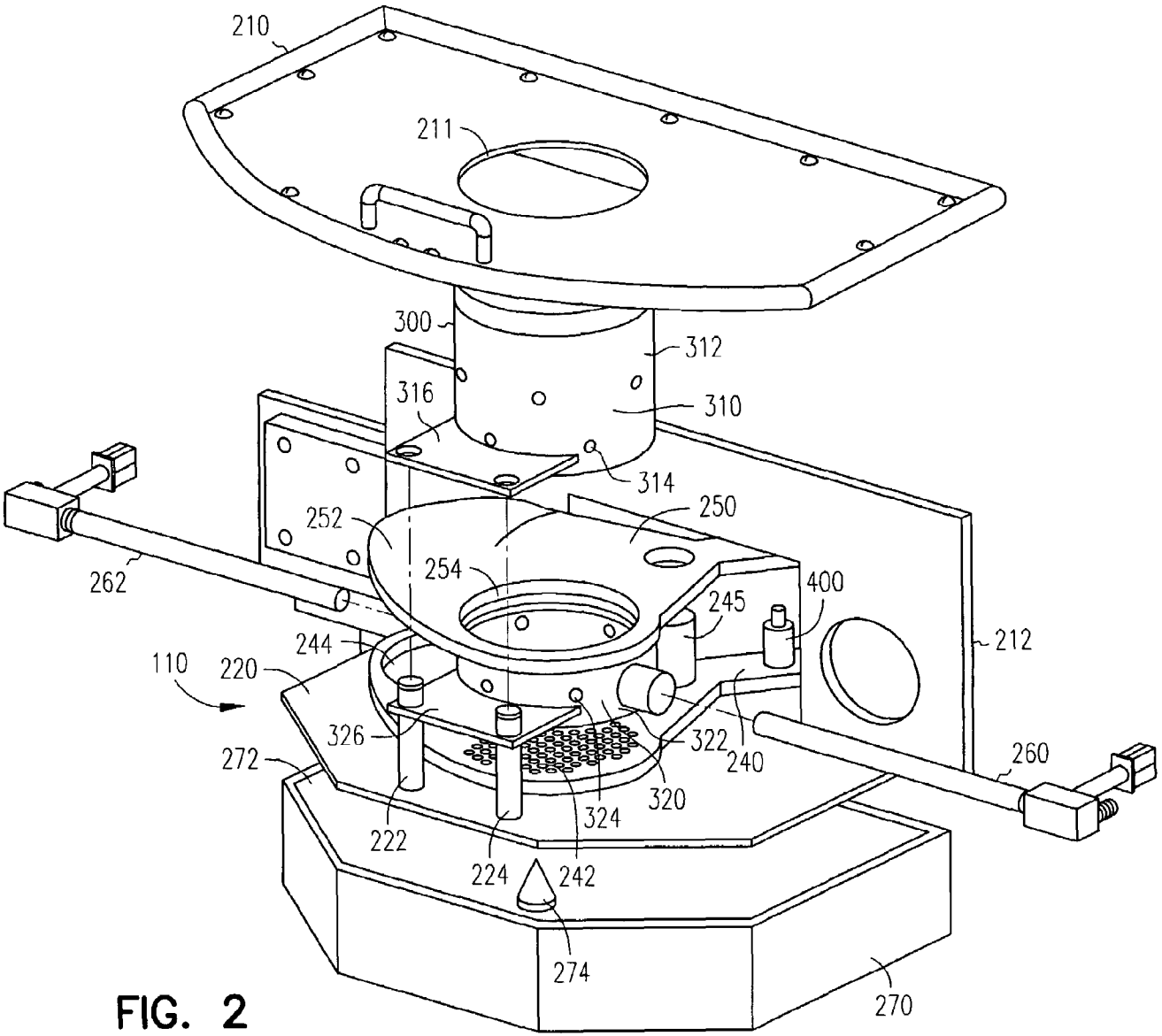
FIG. 2 is an exploded perspective view of a portion of the combustion chamber and the burn pot of the furnace, according to an embodiment of this invention.

FIG. 2 is an exploded perspective view of a portion of the combustion chamber 110 and the burn pot 300 of the furnace 100, according to an embodiment of this invention. The combustion chamber 110 is bounded by a top burner plate assembly 210 and a bottom plate 220. The combustion chamber also includes a back wall 212. Attached to the bottom plate 220 is a first pin 222 and a second pin 224. The burn pot assembly 300 includes a first burn pot portion 310 and a second burn pot portion 320. The first burn pot portion includes a side wall 312. The side wall 312 has openings, such as opening 314 therein, for directing combustion air around the burn pot assembly 300. The second portion of the burn pot 320 also has a side wall 322. The sidewall 322 also includes openings, such as opening 324, for directing air entering from outside the burn pot assembly 300 to within the burn pot assembly. Also attached to the side wall 322 of the second burn pot portion 320 is a mounting wing 326. The mounting wing 326 includes openings that allow the mounting wing 326 to fit over the first pin 222 and the second pin 224 attached to the bottom plate 220 of the combustion chamber 110. Attached to the side wall 312 of the first burn pot portion is another mounting wing 316, which has opening therein so that the mounting wing 316 also fits over the first pin 222 and the second pin 224 of the bottom plate 220 of the combustion chamber 110.

Also located within the combustion chamber is a movable floor 240 and a translating plate 250. The movable floor includes a grill 242 and an opening 244. The movable floor 240 is attached to a pivot pin 245 so that the moving floor 240 can pivot around the pivot pin 245. The translating plate 250 also has an opening 254 therein. The translating plate 250 also includes a solid surface area 252. The translating plate 250 also is pivotally attached to the pivot pin 245. An actuator rod 400 is attached to the movable floor 240 as well as the translating plate 250. The actuator rod 400 is used to move the movable floor 240 and the translating plate 250 between a first position and a second position. In some embodiments, separate actuator rods are used to move the movable floor 240 and the translating plate 250.

Also attached to the burn pot assembly 300, and specifically to the second portion of the burn pot 320, is an igniter 260 and an igniter 262. The igniters 260, 262 place heated air into the burn pot assembly 300. The igniters 260, 262 are in fluid communication with the interior portion of the burn pot assembly. The igniters 260, 262 are used to initially fire the furnace or to initially ignite biomass fuel added to the burn pot assembly 300. Once the biomass fuel within the burn pot has been started, the igniters 260, 262 no longer place heated air into the burn pot assembly 300.

Positioned below the bottom plate 220 is a combustible product tray 270. The combustible product tray 270 includes a floor 272 as well as at least one side wall. Attached to the floor 272 of the combustible product tray 270 is a distributor 274. The distributor 274 is positioned so that when a portion of an ash column is removed from the burn pot assembly 300, the distributor 274 prevents the product from merely stacking up on the floor 274 of the combustible product tray 270. In other words, the distributor 274 distributes the byproduct of combustion from the burn pot over the floor 272 of the combustible product tray 270.

As shown in FIG. 2, the movable floor 240 and the translating plate 250 are in a first position. While in the first position, the grill 242 having openings therein of the movable floor 240, the second portion of the burn pot 320, the opening 254 in the translating plate 250, and the first portion of the burn pot 310 are substantially aligned to form the burn pot assembly 300. When the translating plate 250 and the movable floor 240 are in the first position, the biomass material can be inserted into the burn pot assembly 300 and specifically can drop to the grill portion 242 of the movable floor 240. The igniters 260, 262 are turned on to initially ignite the biomass material. Once the biomass material is burning, additional biomass material is placed through an opening 211 in the top burner plate assembly 210 and into the burn pot assembly 300. Combustion air can be forced through the openings 314 within the first burn pot portion 310 and through the openings 242 in the second burn pot portion 320, respectively, to provide sufficient oxygen for the biomass fuel to burn completely. As burning continues, an ash column 500 (shown in FIGS. 5-7) builds within the burner pot assembly 300. The ash column 500 eventually builds up to a point where the ash column 500 is above the second portion of the burn pot 320, and above the translating plate 250.

Figure 3:
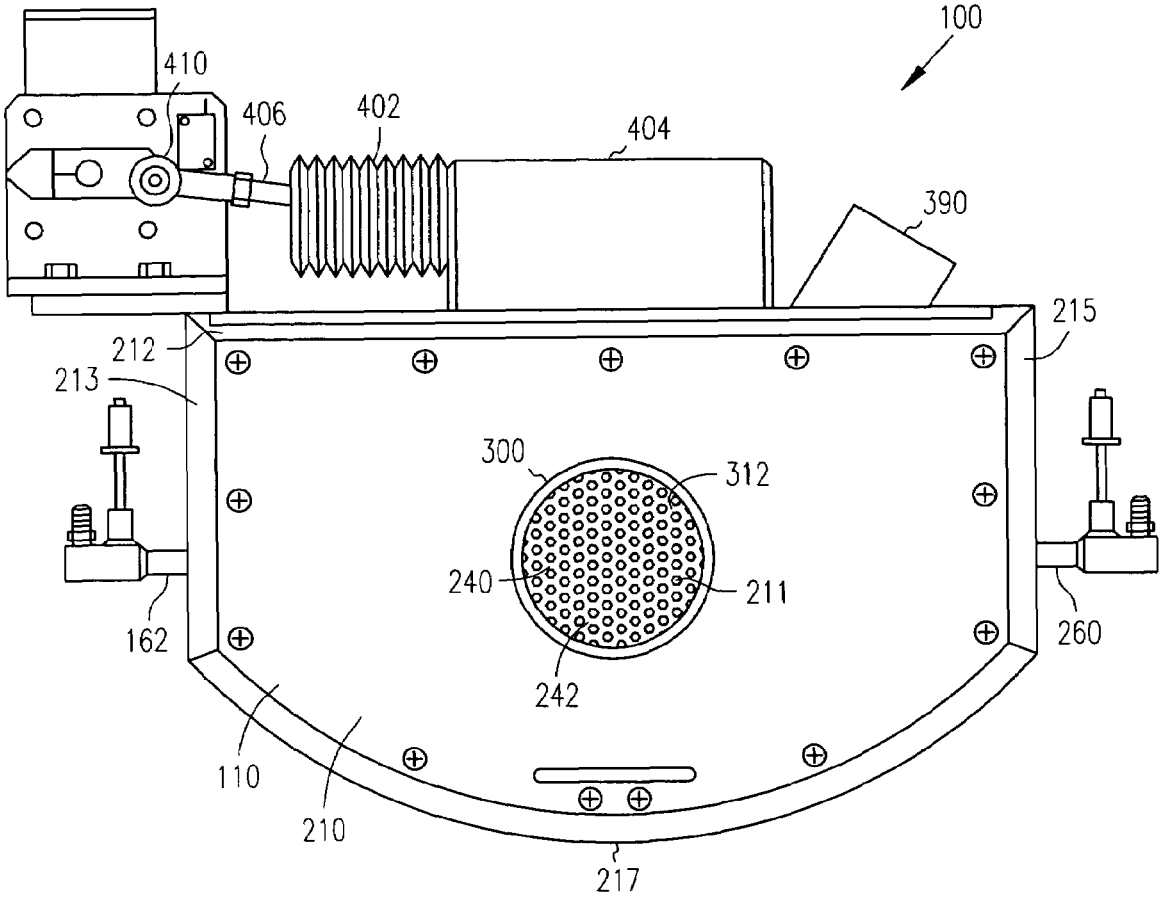
FIG. 3 is a top cross-sectional view of a furnace having a combustion chamber with the burn pot, according to an embodiment of this invention.

FIG. 3 is a top cross sectional view of the furnace 100 and specifically the combustion chamber 110 with the burn pot assembly 300. As shown in FIG. 3, the combustion chamber 110 also includes side walls 213 and 215, as well as a front wall 217. The igniters 260, 262 extend through openings in the side walls 215, 213, respectively. The actuator rod 400 is moved by an actuator motor 410. The combustion chamber 110 also includes a forced air inlet 390. The actuator rod 400 is covered by a bellows 402, as well as a housing 404 attached to the back wall 212 of the combustion chamber 110. As shown in FIGS. 2 and 3, the ends of the movable floor 240 and the translating plate 250 extend through an opening in the back wall 212. The actuator motor 410 and the actuator rod 400 are used to move the translating plate 250 and the movable floor 240 between a first position and a second position. As shown in FIG. 3, the translating plate 250 and the movable floor 240 are in a first position where the grill 242, the second portion of the burn pot 320, the opening 254 within the translating plate 250, and the first portion of the burn pot 310, are substantially aligned with the opening 211 in the top burner assembly.

Figure 4:
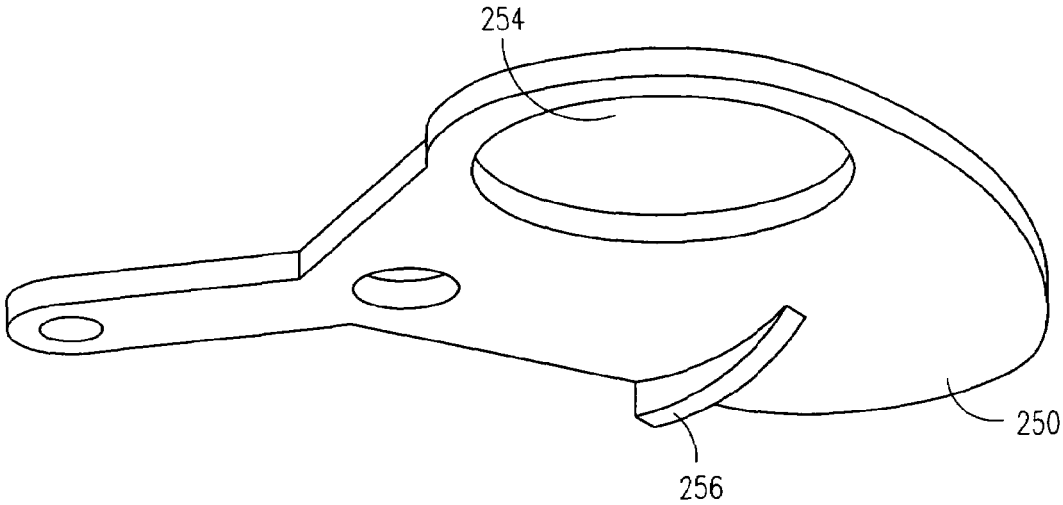
FIG. 4 is a bottom perspective view of the translating plate of the burn pot assembly, according to an embodiment of this invention.

FIG. 4 is a bottom perspective view of the translating plate 250. The translating plate 250 includes the opening 254, as well as a ramp 256 attached near one edge of the translating plate 250. The ramp 256 is positioned within the solid area of the translating plate 250. The ramp 256 is used when the translating plate 250 is moved to a second position, which will be discussed below.

Figure 5:
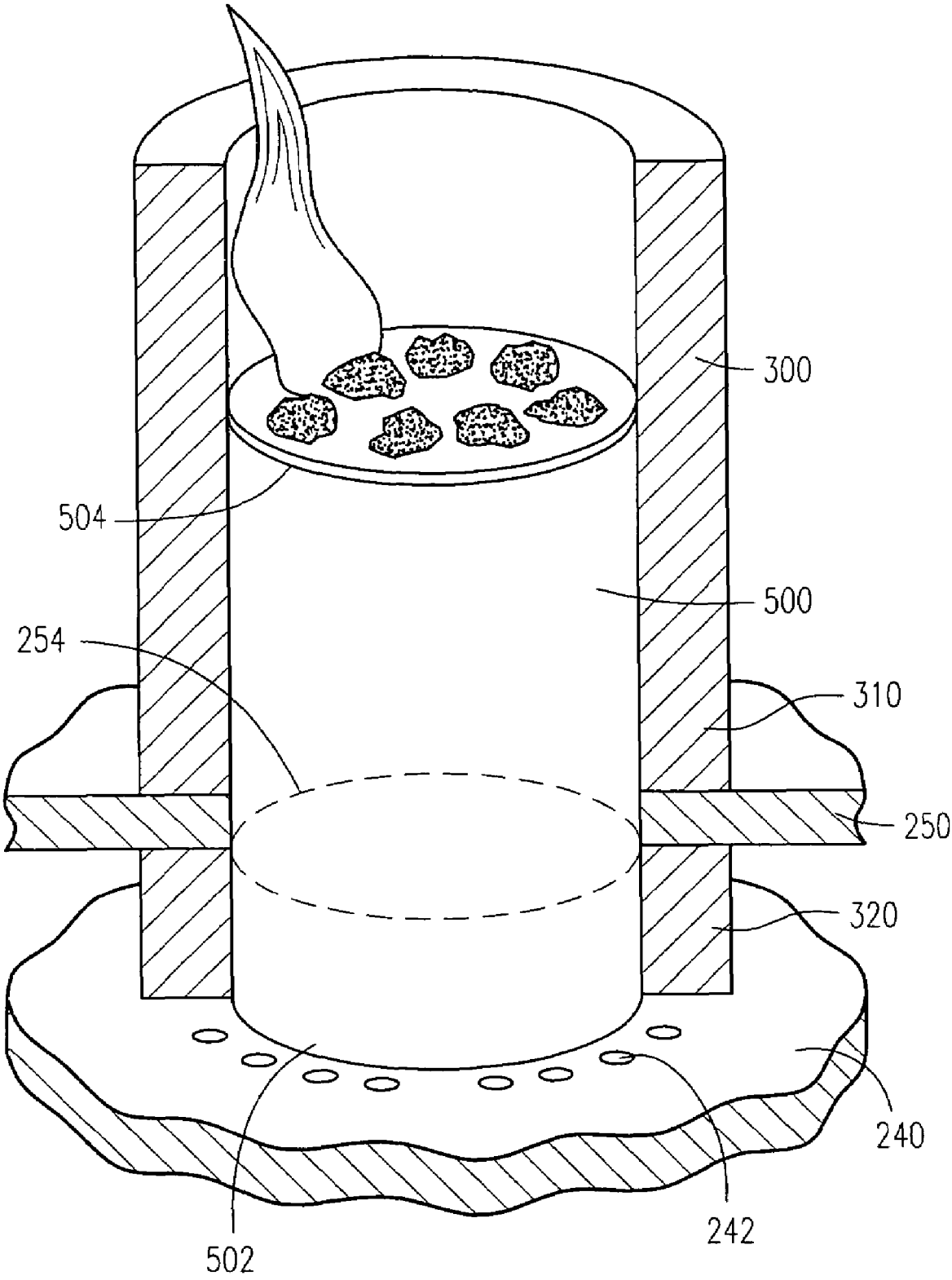
FIG. 5 is a partial cut-away perspective view of the ash column within the burn pot assembly, according to an embodiment of this invention.

FIG. 5 is a partial cutaway perspective view of an ash column 500. The ash column 500 has an end which rests on the grill 242 of the movable floor 240, designated by the reference numeral 502. The ash column 500 also includes an end where immediate combustion is taking place, as designated by the reference numeral 504. When the ash column 500 reaches a height that is above the translating plate 250, the translating plate 250 and the movable floor 240 are moved substantially simultaneously to a second position. Thus, the edge of the opening 254 in the translating plate 250 will cut off a portion of the ash column 500. The opening 254 is shown in dotted lines in FIG. 5.

Figure 6:
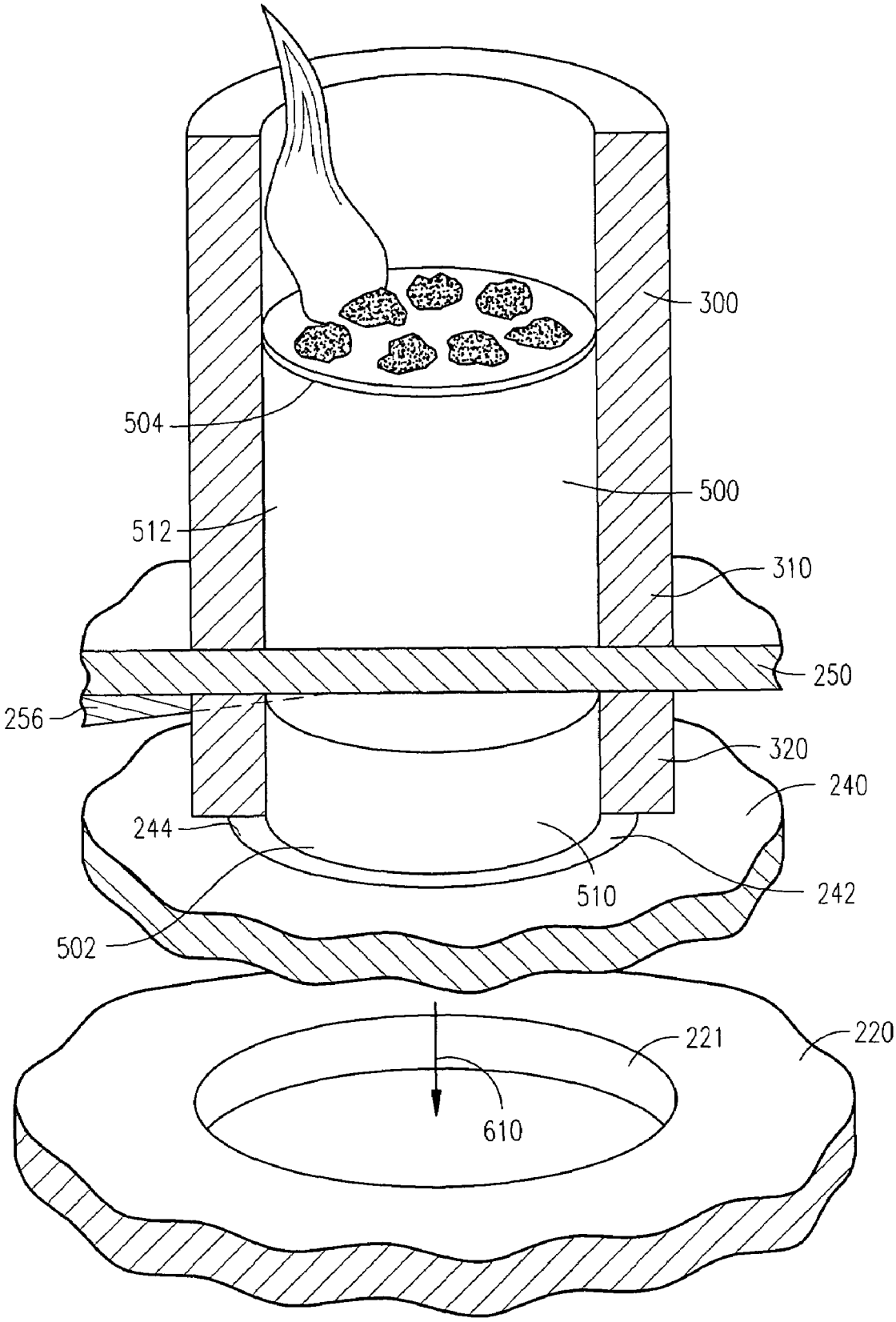
FIG. 6 is a partial cut-away perspective view of the ash column within the burn pot assembly after the movable floor and the translating plate have been moved to a second position, according to an embodiment of this invention.

FIG. 6 is a partial cutaway perspective view of an ash column 500 after the movable floor 240 and the translating plate 250 have been moved to a second position, according to an embodiment of this invention. By moving the translating plate 250 to a second position, a bottom portion or puck 510 is cut off from the main ash column 500. In other words, the translating plate 250 is moved from a first position where it has an opening to a second position where the translating plate is solid. As it is moved, the opening acts as a knife to cut the ash column into a first portion or puck 510 and a second portion 512. In addition, as the movable floor 240 is moved from the first position to the second position, the opening 244 is positioned below the first portion 510 or puck. The ramp 256 of the translating plate 250 forces the puck 510 to drop into the opening 244 in the movable floor. Thus, the end result is the ash column 512 is chopped off or a portion of the ash column is removed while the combustible end 504 remains burning. The puck or portion of the ash column 510 is either forced or drops into the opening 244 within the movable floor 240, as depicted by the arrow 610.

The bottom plate 220 also includes an opening 221, which is an entrance to the combustible product tray 270. Therefore, after the puck 510 drops through the opening 244 it drops through the opening 221 and into the combustible product tray 270. Now returning briefly to FIG. 2, when the puck drops into the combustible product tray 270, it contacts or hits the distributor 274. The distributor 274 prevents successive pucks 510 from stacking on top of one another. In other words, the distributor 274 distributes the pucks 510 over the floor 272 of the combustible product tray 270. Once the puck 510 is removed from the ash column 500, the translatable plate 250 and the movable floor 240 are moved back to or returned to the first position.

Figure 7:
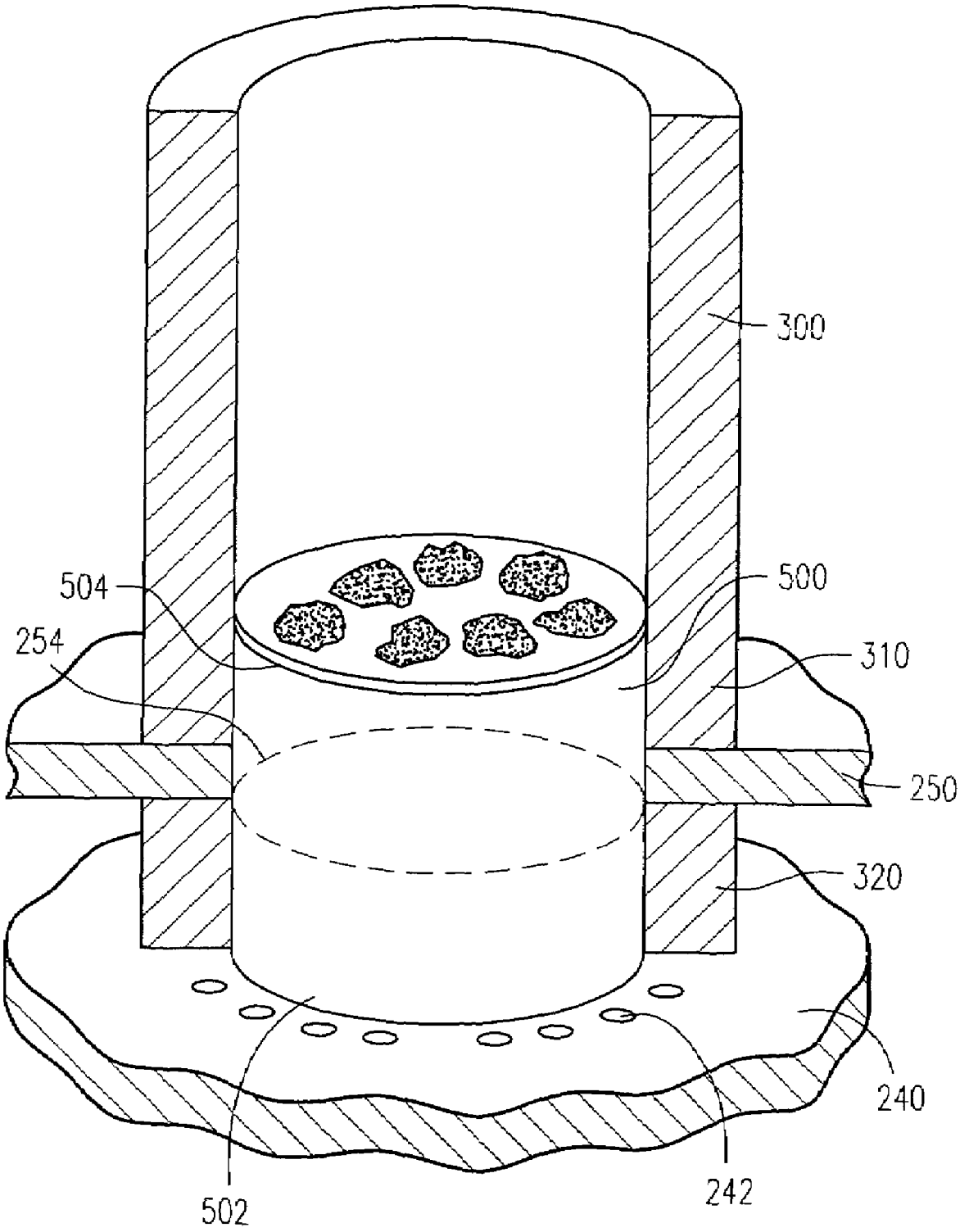
FIG. 7 is a partial cut-away perspective view of the ash column within the burn pot assembly after the movable floor and the translating plate have been returned to a first position, according to an embodiment of this invention.

FIG. 7 is a partial cutaway perspective view of the ash column 500 within the burn pot assembly 300 after the movable floor 240 and the translating plate 250 have been returned to the first position, according to an embodiment of this invention. As can be seen, the ash column 500, which has been shortened after the puck 510 has been removed, drops down through the opening 254 in the translating plate 250. The remaining portion of the ash column 500 then rests upon the grill portion 242 of the movable floor 240. All this is accomplished while the ash column 500 continues to burn during the combustion process.

Figure 8:
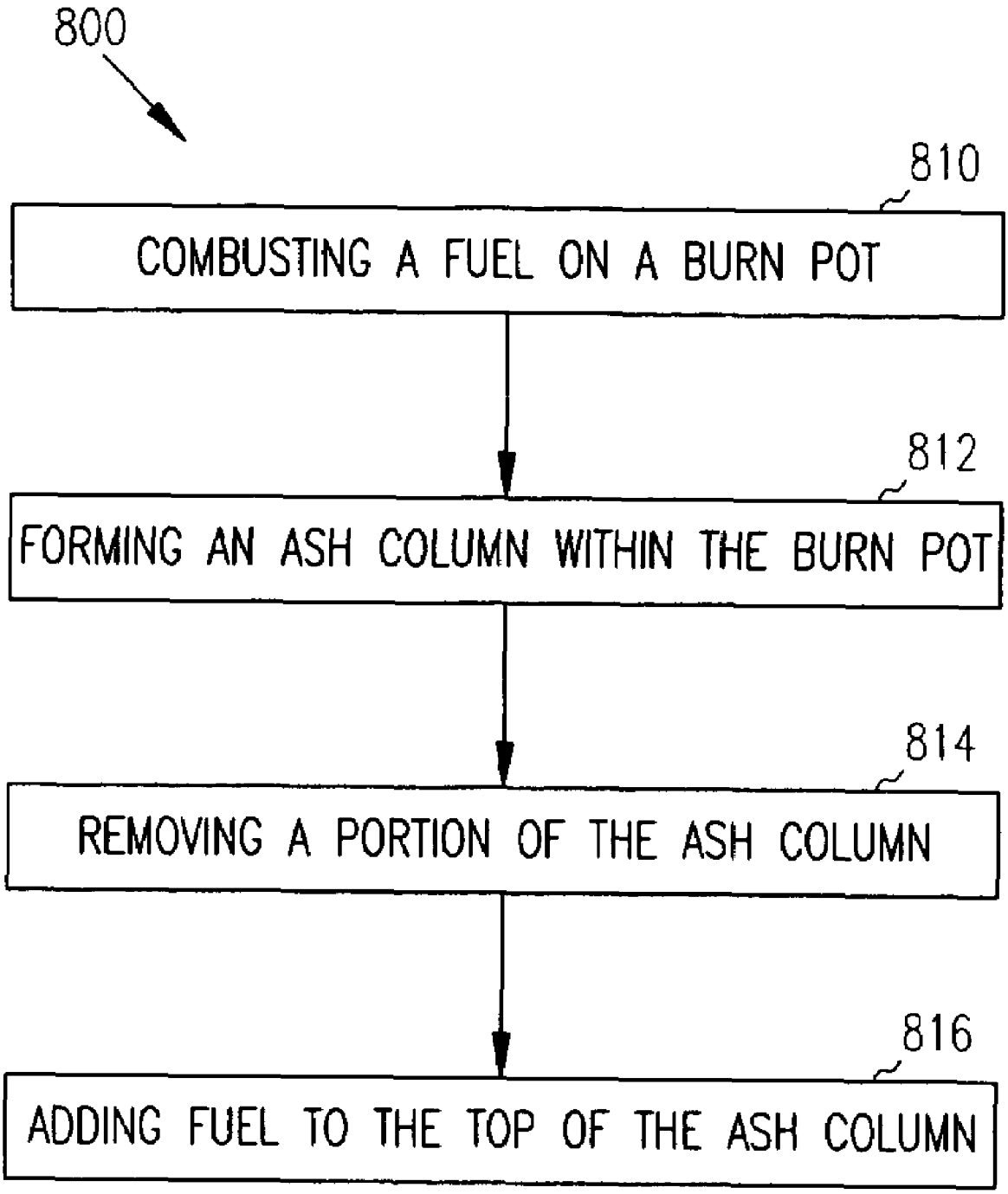
FIG. 8 is a flow diagram of a method for removing ash from a furnace, according to an embodiment of this invention.

FIG. 8 is a flow diagram of a method 800 for removing ash from a furnace, according to an embodiment of this invention. The method 800 includes combusting a fuel in a burn pot 810, forming an ash column within the burn pot 812, and removing a portion of the ash column 814. Removing a portion of the ash column 814 includes cutting a portion of the ash column. In some embodiments, the portion of the ash column that is removed is more completely burned than another portion of the ash column. The method 800 also includes adding fuel to the top of the ash column 816. In some embodiments, removing a portion of the ash 814 column includes removing a bottom portion of the ash column includes removing a portion of the ash column opposite from the end of the ash column that receives fuel. In some embodiments, removing a portion of the ash column 814 includes removing the portion of the ash column during combustion of at least a portion of the ash column. The foregoing description of the specific embodiments reveals the general nature of the invention sufficiently that others can, by applying current knowledge, readily modify and/or adapt it for various applications without departing from the generic concept, and therefore such adaptations and modifications are intended to be comprehended within the meaning and range of equivalents of the disclosed embodiments.

It is to be understood that the phraseology or terminology employed herein is for the purpose of description and not of limitation. Accordingly, the invention is intended to embrace all such alternatives, modifications, equivalents and variations as fall within the spirit and broad scope of the appended claims.

What is claimed is:

1. A furnace comprising:

a combustion chamber;

a burn pot within the combustion chamber further comprising:

a sidewall; and a plate translatable through an internal volume of the burn pot positioned between the ends of the sidewall, the plate translatable between a first position and a second position, wherein the plate has an opening therein with an area at least as large as a cross-sectional area of the burn pot when in a first position and includes an area capable of covering the cross-sectional area of the burn pot when the plate is in a second position, the plate further including a ramp positioned near the opening in the plate; and a movable floor, wherein the plate is moved to form separate volumes of the burn pot.

2. The furnace of claim 1 wherein the movable floor is movable between a first position and a second position.

3. The furnace of claim 1 wherein the movable floor is movable between a first position and a second position, the movable floor having an opening therein having a cross-sectional area at least as large as the cross-sectional area within the sidewall and proximate the movable floor.

4. The furnace of claim 1 wherein the movable floor is movable between a first position where the movable floor has a grill portion therein, the grill portion positioned near an end of the burn pot, and a second position where the movable floor has an opening therein.

5. The furnace of claim 1 wherein the sidewall includes openings therein for directing air entering the burn pot.

6. The furnace of claim 1 further comprising an actuator for moving the movable floor.

7. The furnace of claim 1 wherein the plate translatable through an internal volume of the burn pot moves with the movable floor.

8. The furnace of claim 1 further comprising an actuator for moving the translatable plate.

9. The furnace of claim 1 further comprising an actuator for moving the translatable plate and the movable floor substantially simultaneously.

10. The furnace of claim 1 wherein the sidewall further comprises:

a first sidewall portion; and a second sidewall portion the plate interposed between the first sidewall portion and the second sidewall portion, the plate capable of a position where the inside surface of the opening in the plate is substantially contiguous with the inside surface of the burn pot.

11. The furnace of claim 10 wherein the plate includes a portion capable of separating the first sidewall portion from the second sidewall portion.

12. The furnace of claim 10 wherein the plate includes a portion capable of separating the first sidewall portion from the second sidewall portion, wherein the portion includes a plurality of grill openings therein.

13. The furnace of claim 10 wherein the plate includes an actuator for translating the translatable plate.

14. The furnace of claim 10 wherein the movable floor includes a grill in a first area and has an opening therein in a second area.

15. The furnace of claim 14 further comprising an actuator for moving the movable floor between at least a first position and a second position, wherein the grill is positioned near an end of the second portion of the burn pot when in a first position and wherein the opening is positioned near an end of the second portion of the burn pot when in a second position.

16. The furnace of claim 1 further comprising an actuator for moving both the movable floor and the translatable plate.

17. The furnace of claim 16 wherein the actuator for moving the movable floor and the translatable plate substantially simultaneously.

18. The furnace of claim 10 further comprising an igniter in fluid communication with the burn pot.

* * * * *